US007448598B1

(12) United States Patent
Elmlinger et al.

(10) Patent No.: US 7,448,598 B1
(45) Date of Patent: Nov. 11, 2008

(54) QUICK PANEL LIFTER

(76) Inventors: Patrick Elmlinger, 1315 Route 82, Hopewell Junction, NY (US) 12533; Gaetano Paolo Messina, 1323 Route 82, Hopewell Junction, NY (US) 12533

( * ) Notice: Subject to any disclaimer, the term of this patent is extended or adjusted under 35 U.S.C. 154(b) by 0 days.

(21) Appl. No.: 12/070,482

(22) Filed: Feb. 19, 2008

(51) Int. Cl.
*B66D 1/36* (2006.01)

(52) U.S. Cl. ..... 254/338; 414/11; 52/127.2

(58) Field of Classification Search ..... 254/329, 254/334, 338; 414/10, 11; 52/127.2
See application file for complete search history.

(56) References Cited

U.S. PATENT DOCUMENTS

| | | | | |
|---|---|---|---|---|
| 3,828,942 | A | 8/1974 | Young | |
| 4,027,802 | A | 6/1977 | Reynolds | |
| 4,148,465 | A * | 4/1979 | Bowman | 254/334 |
| 4,283,164 | A * | 8/1981 | Reaney | 414/396 |
| 5,129,774 | A | 7/1992 | Balseiro et al. | |
| 5,169,279 | A * | 12/1992 | Zimmerman | 414/703 |
| 5,284,324 | A * | 2/1994 | Bunger | 254/266 |
| 5,303,899 | A | 4/1994 | Palya | |
| 5,368,429 | A | 11/1994 | Young | |
| 5,441,379 | A * | 8/1995 | Gilbert, Jr. | 414/494 |
| 5,704,755 | A | 1/1998 | Jesperson | |
| 5,833,430 | A | 11/1998 | Reynolds et al. | |
| 6,019,561 | A | 2/2000 | Thomson et al. | |
| 6,082,945 | A | 7/2000 | Jeffries et al. | |
| 6,497,399 | B1 | 12/2002 | Nelson | |
| 6,508,448 | B1 | 1/2003 | Stewart | |
| 6,511,275 | B2 | 1/2003 | Ray | |
| 6,527,088 | B1 * | 3/2003 | Fowler | 187/239 |
| 6,688,374 | B2 * | 2/2004 | Dondlinger | 160/340 |
| 7,021,606 | B2 | 4/2006 | Raycraft | |

* cited by examiner

*Primary Examiner*—Emmanuel M Marcelo
(74) *Attorney, Agent, or Firm*—Aziz M. Ahsan; Ahsan & Associates, PLLC

(57) ABSTRACT

The present invention relates generally to a panel lifting device. More particularly, the invention encompasses a method and an apparatus for quickly and securely lifting panels. The invention further includes the option of the apparatus being foldable and/or modular for easy transportation from one location to another location.

20 Claims, 11 Drawing Sheets

QUICK PANEL LIFTER

FIELD OF THE INVENTION

The present invention relates generally to a panel lifting device. More particularly, the invention encompasses a method and an apparatus for quickly and securely lifting panels. The invention further includes the option of the apparatus being foldable and/or modular for easy transportation from one location to another location.

BACKGROUND INFORMATION

In the housing construction or remodeling industry it is common to have several people involved in the placement and securing of a panel, such as, a sheetrock or drywall panel to a vertical wall. For example, just to place one panel of drywall to an upper portion of a wall, it has been routine and necessary for two or three people to hold a panel of the drywall to the vertical wall of a normal wall height (8 to 9 feet) in order for another person not holding the drywall panel to nail or glue the drywall panel to the wall. In such situations it is generally awkward and virtually impossible for one person to hold a heavy drywall panel of say sheetrock in position and nail the panel of drywall at the same time, since drywall is typically pushed up to its location for a nice tight fit.

Another condition that has given rise to specialized tools is the need to meet consumer requirements, such as, the desire to have higher ceilings, cathedral ceilings, 9 to 12 foot ceilings, etc. In these situations, placing panels of sheetrock to the higher areas may be limited and hazardous. There are a few designs of construction lifting apparatus that have been created to allow an operator to lift or move a heavy object, such as, drywall panels and glass panels, which may be lifted to a height where they may be transferred onto a panel lifter having an extended height capability and which are more specifically designed for outer wall use. These tools are often described as devices for lifting and transporting panels.

U.S. Pat. No. 3,828,942 (Roland O. Young), the disclosure of which is incorporated herein by reference, discloses a lifting device for lifting ceiling panels into place flush against the ceiling beams for installation. The device has a supporting structure for supporting the panel and telescoping sleeves for raising and lowering the panels. The device also has a cable and pulley connecting structure for telescoping the sleeves with a drum or spool for winding the cable and a brake mechanism for the drum. The supporting structure may also be pivoted at an angle and carry thereon panels for installation against the upright wall framework.

U.S. Pat. No. 4,027,802 (Francis E. Reynold), the disclosure of which is incorporated herein by reference, discloses a building panel positioner which permits a building board or panel to be positioned adjacent a ceiling or wall framework in building construction. The device comprises a base from which a bottom, intermediate and top section vertically extend in telescoping interfitted adjustably extending relation to each other with support means having a planar surface for support of the board or panel. The support means has retaining means associated therewith to prevent lateral movement with respect thereto. In addition, the retaining means has locking means associated therewith to prevent outward movement of the board or panel relative to the planar surface.

U.S. Pat. No. 5,129,774 (Balseiro, et al.), the disclosure of which is incorporated herein by reference, discloses an apparatus for lifting a panel to a ceiling that has a post having an upper end and a lower end, a spring in the post between the upper and lower ends for at least limited longitudinal compression of the post against a spring force, and a foot pivoted on the lower end about a foot axis transverse to the longitudinal axis. A handle is pivoted on the post between its ends about a handle axis generally parallel to the foot axis and a panel-engaging support bar is pivoted on the upper end of the post about a bar-pivot axis generally parallel to the foot and handle axes, extends perpendicular to this bar-pivot axis, and has one end provided with an outwardly directed cleat. Thus this bar can be engaged under the panel with the cleat against an edge of the panel. At least one bar spring is operatively engaged between the bar and the post for biasing the bar into a position extending perpendicular to the post.

U.S. Pat. No. 5,303,899 (Jerome C. Palya), the disclosure of which is incorporated herein by reference, discloses a device for lifting panels by a single individual may cause such panels to be elevated vertically in connection with a structure to a location considerably higher than that which the person is located, without the use of ladders. A frame is mounted and erected vertically and a panel slides upwardly by a winch operation until in position to secured to the structure. Legs may be attached to said frame by which a work table may be provided to work on such panels prior to installation.

U.S. Pat. No. 5,368,429 (Roland O. Young), the disclosure of which is incorporated herein by reference, discloses a panel lifting apparatus having at least three telescoping elongated sections telescoping into one another and all telescoping into a non-telescoping elongated frame member. Three separate chain length segaments not directly connected to one another act to raise and lower the telescoping sections. The first chain segament has its upper and lower end mounted to the upper and lower end of the first telescoping section. The second chain segament has its upper end connected to the upper end of the non-telescoping section and its lower end connected to the lower end of the second telescoping section. The third chain segament has its upper end connected to the upper end of the first telescoping section and its lower end connected to the lower end of the third telescoping section. The non-telescoping section has a gear drive with its output gear engaging the first chain segament to raise and lower the first chain segament to thereby raise and lower the first telescoping section. The raising and lowering of the first telescoping section raises and lowers simultaneously the second and third telescoping sections through the chain segament connections.

U.S. Pat. No. 5,704,755 (Thomas Francis Jesperson), the disclosure of which is incorporated herein by reference, discloses a panel lifting apparatus for detachable attachment to a panel lifting hoist or trolley. The apparatus comprises a primary support member, a clamp for gripping engagement with a panel to be lifted, a control device for actuating the clamp via a cable linking the clamp and the control device. When a panel is to be lifted from a position off the apparatus and onto the hoist or trolley, the clamp is brought into engagement with the panel and the control device is actuated to draw the panel onto the hoist or trolley enabling the support and carriage of same.

U.S. Pat. No. 5,833,430 (Douglas B. Reynolds, et al.), the disclosure of which is incorporated herein by reference, discloses yet another type of apparatus which provides a mast and a cable-operated winch for pivot-lifting horizontally-manufacture wall frames to the vertical position, utilizing upper and lower sections of 2".times.6" lumber to form the length of the mast. Top and bottom mast elements have hollow box sockets, into which the lengths of lumber are telescoped, and a middle mast element carries a winch with the cable hooked to the top rail of the wall frame. This is designed primarily for outside wall use.

U.S. Pat. No. 6,019,561 (Thomson, et al.), the disclosure of which is incorporated herein by reference, discloses a collapsible device for assisting a construction worker in erecting a framed wall. The device includes an elongated telescoping arm having a planar foot member at a first end thereof for vertically securing the arm to a floor. A first end of an elongated nylon strap is attached to a retraction mechanism on the arm. A second end of the nylon strap has a bracket thereon for securing to the top of a wall. The telescoping arm has a weight indication means for indicating to a user the weight of a wall being erected thereby. Accordingly, the strap may be secured to a horizontally oriented wall and the nylon strap is retracted causing the wall to pivot to a vertical position. The telescoping arm allows the device to be easily collapsed for transport or storage.

U.S. Pat. No. 6,082,945 (Jeffries, et al.), the disclosure of which is incorporated herein by reference, discloses a sheet material lifting and retaining apparatus including a shaft member having a longitudinal axis. A gas cylinder assembly is secured to the shaft member, the gas cylinder assembly having an axis of operation that is generally coaxial with the longitudinal axis of the shaft member. A sheet material contact member is secured to the gas cylinder assembly. The shaft member can include a length adjustment mechanism, which may be provided as a telescoping tube arrangement having a plurality of telescoping aluminum tubes. The gas cylinder assembly can include a self-contained gas cylinder. An end fitting can be secured to a first end of the gas cylinder, with a shaft attachment member secured to a second, opposite end of the gas cylinder. An actuator can be provided to selectively control actuation of the gas cylinder. The actuator of the gas cylinder assembly can include a rod portion extending generally parallel to the shaft member. The shaft member can include an attachment bracket adapted to be secured to the shaft attachment member of the gas cylinder assembly. The end fitting can be adapted to be secured to the sheet material contact member, which may be provided as a generally planar nylon block. A floor contact member, which may include a cushion contact surface, can secured to an end of the shaft member opposite the gas cylinder assembly.

U.S. Pat. No. 6,497,399 (Mark S. Nelson), the disclosure of which is incorporated herein by reference, discloses a simple, compact, hands free device that allows a single operator to vertically lift and hold construction panels to a desired height for securing to a wall surface. Downward foot pressure on one end of a slotted lever arm causes a panel lifting surface on the other end of the lever arm to rise. This lever arm is supported by a base support which also supports a locking arm. Once the desired height is reached, the device locks the panel into position. The operator is then free to move about, adjust, and finally secure the panel. Once the panel is secured, the locking arm is released by simple forward pressure. With the aid of a foot strap, the device can then be transported to the next panel ready for lifting. This device eliminates the use of hands, bending, or stooping during the process of lifting construction panels.

U.S. Pat. No. 6,508,448 (Dennis Stewart), the disclosure of which is incorporated herein by reference, discloses another type of prior art device which involves the use of an adjustable drywall support apparatus for holding a gypsum wallboard in place as it is being installed at ceiling level, which includes a support assembly of an elongate tubular and shaft members being telescopingly disposed in the elongate tubular member, with a cross member assembly including a tubular main cross member securely attached to the support assembly and adapted to support a drywall panel.

U.S. Pat. No. 6,511,275 (Charles T. Ray), the disclosure of which is incorporated herein by reference, discloses a lift platform with a pair of panel-supporting legs of square metal tubing attachable to side rails of the lift platform, with each leg being connected to the rails by an upper clamp at the top of the leg and a lower clamp at a middle location. A panel-receiving U-shaped channel is located on the opposite side of the leg, away from the rails, while the lower clamp has a standoff member included in its connection to the leg serving to project the bottom of the legs outward at an angle. Rollers at the top and bottom provide low-fiction rolling contact for weight bearing surfaces.

U.S. Pat. No. 7,021,606 (Mark E. Raycraft), the disclosure of which is incorporated herein by reference, discloses a lightweight apparatus related generally to lifting heavy objects of construction materials by a single individual, such as panels of sheetrock to inside or outside walls, easily accommodating walls up to 12 feet in height, including angled walls. It is more particularly directed to raising panels of sheetrock to upper portions of a wall and holding the panel in place while an individual nails or screws the sheetrock to the wall studs. A triangular sling-like attachment secures a panel of drywall being lifted by turning the winch. Another attachment on the top section allows the apparatus to lean against the studded wall. The vertical panel lift allows the worker to handle with ease drywall panels that are ¼", ⅜", ½" and ⅝" thick, in addition to holding in place drywall panels as large as 54" wide and 16 feet long.

Even with these improvements, a need exists for an improved way to install large panels, such as, sheets of sheetrock to inner walls safely by a single operator.

Thus a need exists for a device which is mobile, light in weight and easy to use in the housing construction and remodeling industry to hang sheetrock and similar other construction materials by a single individual.

A need also exists for a simple, lightweight panel installing device that is easy to carry to a jobsite, yet having an effective mechanism to lift sheetrock and hold the panel against the wall while the construction panel is being secured to the vertical wall.

Furthermore, a need also exists for an adjustable tool with an adjustment mechanism having significant holding strength once the desired height is selected.

This invention overcomes the problems of the prior art. The invention provides a design that is compact and has easy maneuverability for the operator. The apparatus is self-standing at any position during the complete cycle from loading of the panel to the final installation of the panel.

This inventive device engages the panel, such as, a sheetrock, at the bottom by contact only, and disengages once the panel is fastened in place and the loader is removed. One person can easily and safely operate this apparatus.

The upper tubular section of the inventive device can be quickly swapped with one having different length to accommodate various wall heights.

PURPOSES AND SUMMARY OF THE INVENTION

The invention is a novel method and an apparatus for quickly and securely lifting panels.

Therefore, one purpose of this invention is to provide a novel method and an apparatus for quickly and securely lifting panels.

Another purpose of this invention is to provide a lightweight apparatus which allows a single operator to lift heavy panels from a base level to a height of about 12 feet, and to be able to securely secure the panel at the desired location.

Yet another purpose of this invention is to have a quick panel lifting device that will hold a stable position during the operation of raising and securing of a panel.

Still, yet another purpose of this invention is to have a panel lifting device that is a self-standing unit, and stays upright with or without a load.

Yet another purpose of this invention is to provide an improved and efficient method for lifting and installing panels.

Still, yet another purpose of this invention is to provide a panel lifting device that allows the easy and quick retrofitting to accommodate different wall heights by interchanging the length of the tubular channel or unit.

Therefore, in one aspect this invention comprises a panel lifting device, comprising:

(a) a channel, wherein one end of said channel is secured to a base, while a second end of said channel is secured to a top assembly, wherein said channel has at least one traveling piston slideably secured inside said channel, and wherein said top assembly comprises of at least one roller and at least one pulley;

(b) said traveling piston has a loader secured thereto, wherein said loader has a lip to engage a panel;

(c) a winch mechanism, a lever latch, a gear mechanism, at least one guide pulley and at least one handle secured to said channel;

(d) a cable, wherein one end of said cable is secured to said traveling piston while the second end of said cable is secured to said winch mechanism, and wherein said cable is looped through a pulley in said top assembly and said at least one guide pulley;

(e) wherein said winch mechanism has a winch drive shaft to slidably engage with a rotatable drive shift, such that upon engagement with said rotatable drive shaft said winch drive shaft creates a movement in said cable to vertically move the loader from a first position to a second position.

In another aspect this invention comprises a panel lifting device, comprising:

(a) a channel, wherein one end of said channel is secured to a base, while a second end of said channel is secured to a top assembly, wherein said channel has at least one traveling piston slideably secured inside said channel, and wherein said top assembly comprises of at least one roller and at least one pulley;

(b) said traveling piston has a loader secured thereto, wherein said loader has a lip to engage a panel;

(c) a winch mechanism, a lever latch, a gear mechanism, at least one guide pulley and at least one handle secured to said channel;

(d) a cable, wherein one end of said cable is secured to said traveling piston while the second end of said cable is secured to said winch mechanism, and wherein said cable is looped through a pulley in said top assembly and said at least one guide pulley;

(e) wherein said winch mechanism has a winch drive shaft to slidably engage with a rotatable drive shift, such that upon engagement with said rotatable drive shaft said winch drive shaft creates a movement in said cable to vertically move the loader from a first position to a second position; and (f) wherein said channel has an upper portion and a lower portion, such that said upper portion pivots around said lower portion at a pivot point, and wherein at least one pin secures said upper portion of said channel to said lower portion of said channel at said pivot point.

BRIEF DESCRIPTION OF THE DRAWINGS

The features of the invention that are novel and the elements characteristic of the invention are set forth with particularity in the appended claims. The drawings are for illustration purposes only and are not drawn to scale. Furthermore, like numbers represent like features in the drawings. The invention itself, both as to organization and method of operation, may best be understood by reference to the detailed description which follows taken in conjunction with the accompanying drawings in which:

DETAILED DESCRIPTION

Figure 1:
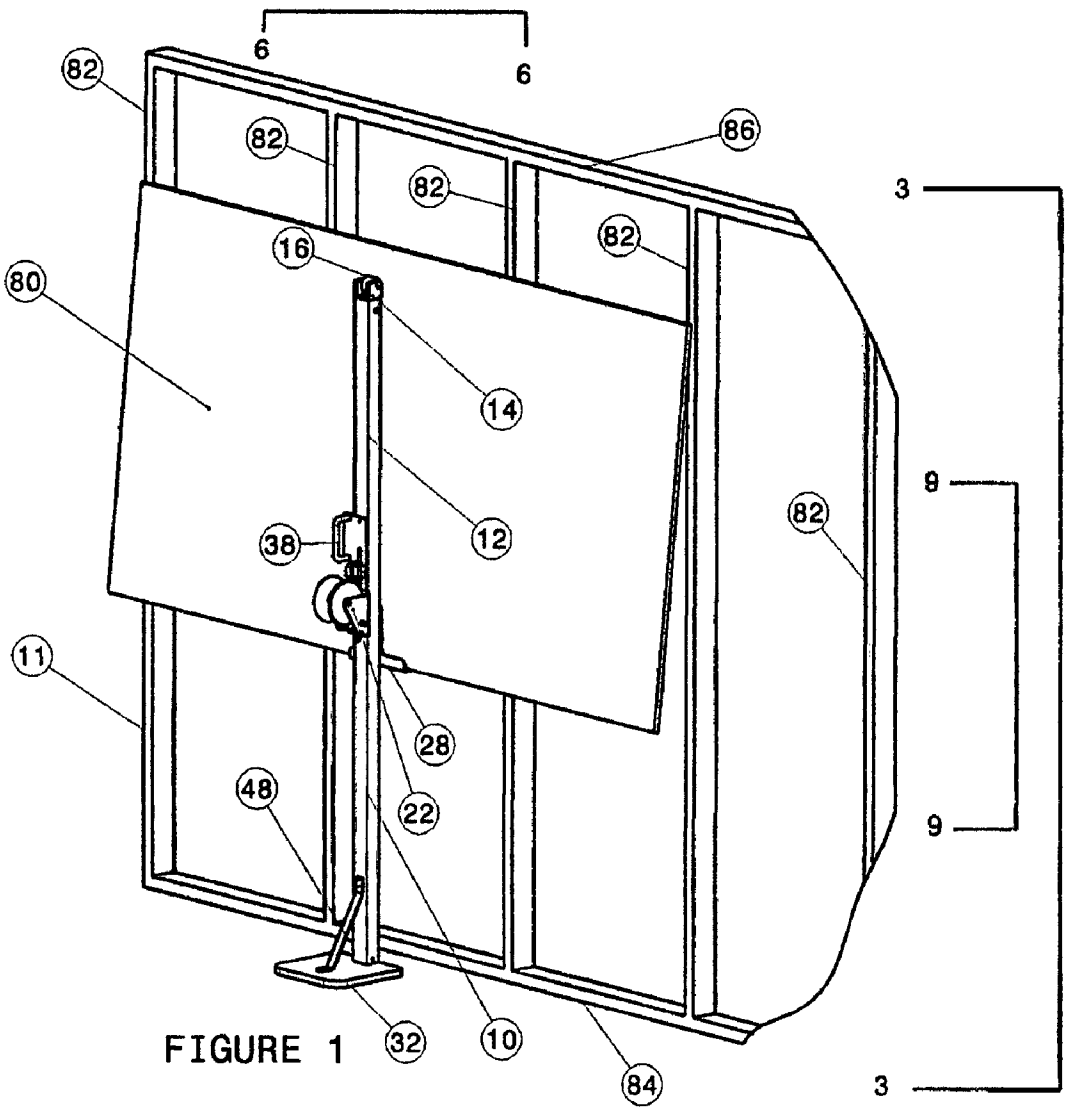
FIG. 1 is an exemplary quick panel lifter which is used to illustrate a first embodiment of the present invention.

Referring to FIG. 1, which illustrates a preferred embodiment of the quick panel lifter 10, where the quick panel lifter 10, is positioned along a typical vertical wall 11, where the wall 11, is either under construction or under repairs. The wall 11, typically has at least one beam 82 or at least one stud 82, with at least one bottom plate 84, and at least one top plate 86. The bottom plate 84, the top plate 86, and beam 82 or stud 82, are securely connected to each other by methods well know in the prior art. As shown in FIG. 1, the quick panel lifter 10, has lifted a panel 80, such as, a sheetrock panel 80, such that the bottom edge of the panel 80, is resting on at least one loader 28, while an upper portion or edge of the panel 80, has been pushed and made to lean towards and rests along the edge of at least one beam 82 or stud 82. As a person skilled in the art would appreciate that this invention can take advantage of gravity by allowing the raising of the panel 80, to a position so that it can be pushed and it can slide along an edge of the beam 82 or stud 82, while it is positioned for eventual placement along the face of the beam 82 or stud 82.

Figure 2:
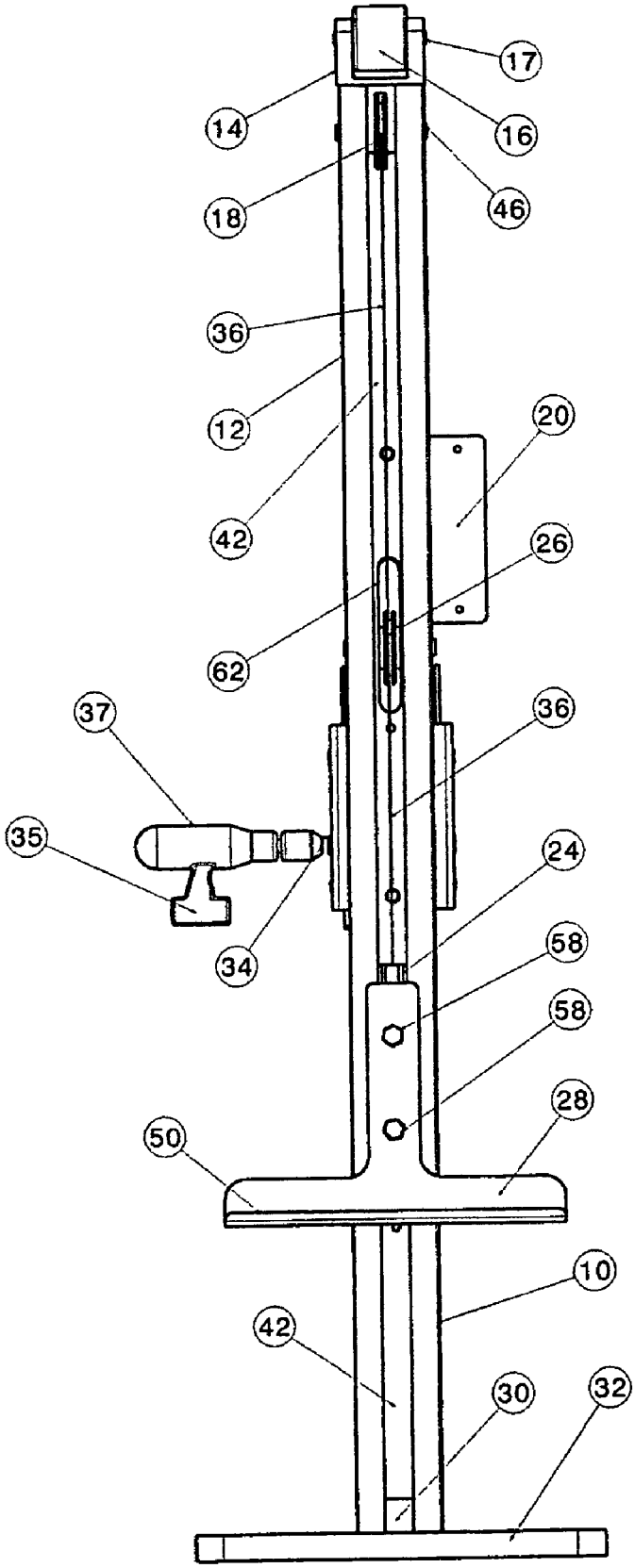
FIG. 2 is a front view of a quick panel lifter.

FIG. 2 is a front view of a quick panel lifter 10. The preferred embodiment of the quick panel lifter 10, has a base 32, and a channel 12, preferably a C-channel 12, secured to the base 32. The channel 12, preferably has a channel slot 42, to allow the vertical movement and containment of various components, such as, for example, a traveling piston 24. The traveling piston 24, preferably has at least one loader 28, having a bend or lip 50, secured thereto via at least one securing device 58, such as, for example, screws 58, spot weld 58, to name a few. One end of a cable 36, is secured to the traveling piston 24, while the other end loops around a pulley 18, on a pin 46, near the top assembly 14, and is guided via at least one pulley guide 26, and is secured to a winch 22. The channel 12, has an opening or slot 62, to receive the guide pulley 26.

Figure 3:
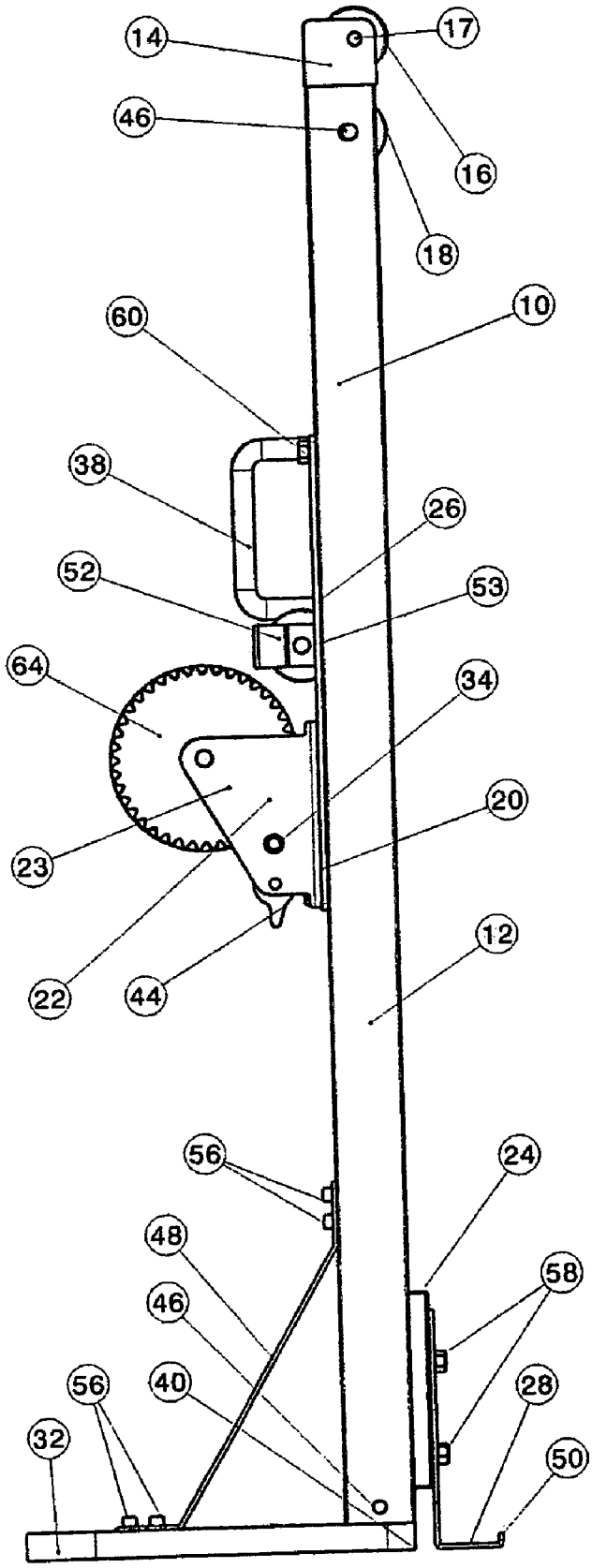
FIG. 3 is a left side view of a quick panel lifter, taken along section 3-3, from FIG. 1.

FIG. 3 is a left side view of a quick panel lifter 10, taken along section 3-3, from FIG. 1. As one can clearly see that the top assembly 14, has at least one roller 16, secured via a pin 17, or similar such device 17. The roller 16, is a free roller 16, which acts as a support roller 16, for the upward or downward movement of a panel 80 (not shown) resting on it. In a preferred embodiment the top assembly 14, containing the roller 16, is inserted into and secured to the channel 12. At least one handle 38, is also provided. The handle 38, is secured to the quick panel lifter 10, via at least one securing device 60, such as a screw 60, or a spot weld 60, or similar such securing device 60. The guide pulley 26, is preferably on a guide post 52, and secured thereto via a pin 53. One or more side plates 23, securely accommodate the winch 22, a winch driver 34 or winch drive shaft 34, a gear mechanism 64, and at least one latch lever 44. The winch driver 34, or winch drive shaft 34, is directly connected to the winch 22, and the winch driver 34 or winch drive shaft 34, allows the rotation of the winch 22, in a clockwise direction or a counter-clockwise direction. The winch 22, has a latch 44, where the latch 44, is preferably a lever that engage/disengage gear 64, to hold and release the winch 22, during the phase of installing and securing the panel 80, in position. The latch 44, is preferably a three-position lever, such that the latch 44, has a first position which is neutral, a second position to engage the gear 64, and a third position to disengage the gear 64, on winch 22. It is preferred that the handle 38, guide post 52, and the winch 22, are all securely attached to the plate 20. It is preferred that the plate 20, is securely attached to the channel 12, using securing means 60, such as, screw 60, or spot welding 60, to name a few. The loader 28, is preferably of an "L" shape, where one portion of the loader 28, is secured to the traveling piston 24, via at least one securing mechanism 58, such as, screw 58, or spot weld 58, to name a few. The loader 28, also has a lip or bend 50, to hold and prevent the sliding of the panel 80 (not shown). It is preferred that at least one bracket 48, secures the channel 12, to the base 32, via a plurality of securing means 56, such as, screws 56, spot welding 56, to name a few. The base 32, has a pivot point 40. Pivot point 40, is the loading line at the time the lifter 10, tilts toward the panel 80, and the roller 16 makes contact with the panel 80.

In a preferred embodiment a drill 35, having a drive shaft 37, such as, a house hold drill 35, is made to mate with the winch driver 34 or winch drive shaft 34, and the rotational movement of the drill drive shaft 37, rotates the winch driver 34, or the winch drive shaft 34, which in turn moves the loader 28, in upward direction or downward direction. In a typical application one would place a panel 80, on the loader 28, while the upper surface of the panel 80, rests on the roller 16. The drive shaft 37, of the drill 35, is then mated with the winch driver 34 or the winch drive shaft 34, and the drill 35, is activated. Upon activation the winch 22, rotates in a first direction so as to create tension in the cable 36, and moves the loader 28, having the panel 80, from a first position to a desired second position. Once the second desired position is reached the operator then uses the handle 38, to make minor adjustments for the eventual placement and securing of the panel 80.

Figure 4:
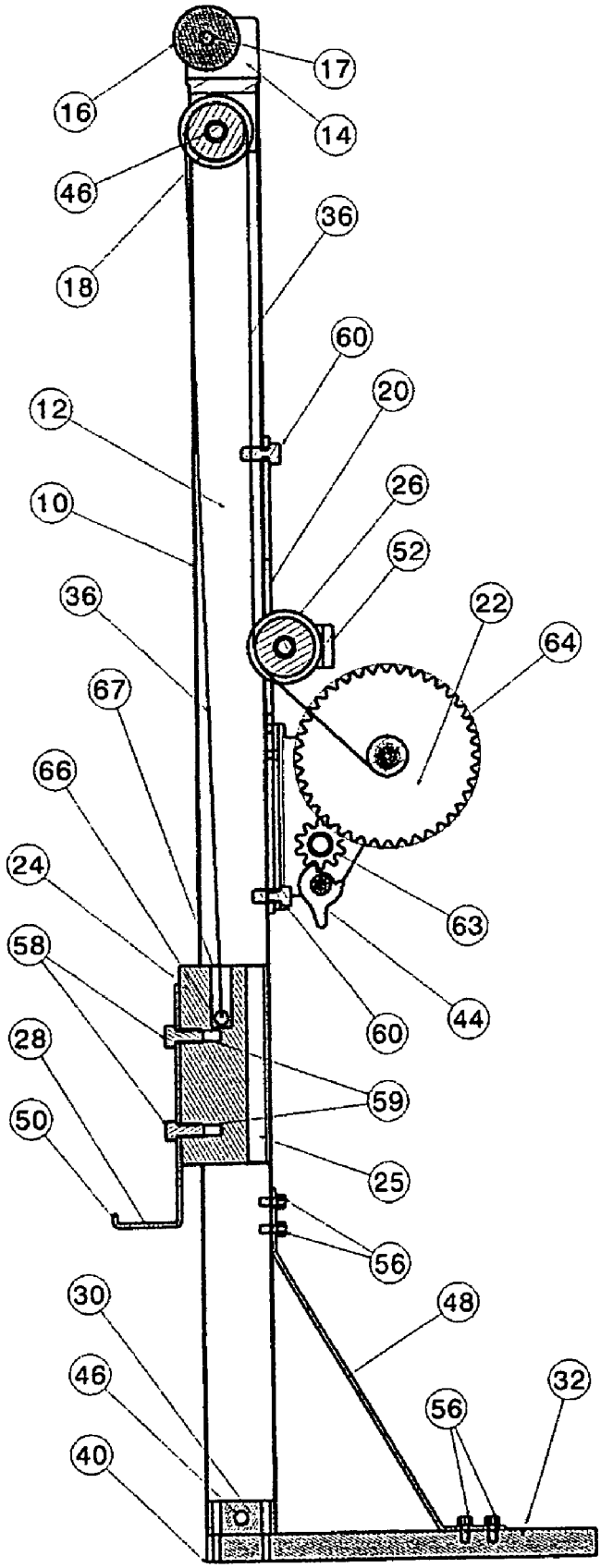
FIG. 4 is a cross sectional cut-out view of a quick panel lifter.

FIG. 4 is a cross sectional cut-out view of the quick panel lifter 10. As one can see that one end of the cable 36, is secured to the winch 22. The cable 36, then passes through guide pulley 26, and feeds over the pulley 18, and the second end of the cable 36, passes through a horizontal pinhole 66, and is attached to the traveling piston 24. Winch 22, allows the winding and unwinding of the cable 36, by pulling or releasing the piston 24. The latch lever 44, is connected to a small gear 63, which in turn is connected to the large gear 64. The movement of the latch lever 44, engage or disengage the gears in the small gear 63. It is preferred that the latch lever 44, engages the small gear 63, while a panel 80, is being lifted and prevent the downward movement of the loader 28, until the latch lever 44, is deliberately and intentionally released. It is preferred that the channel 12, is centered into block 30, and the block 30, is fastened with securing means 46, such as, pin 46.

Figure 5:
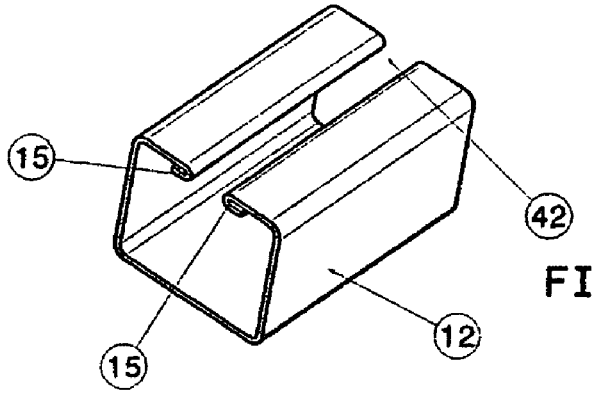
FIG. 5 is an enlarged view of the channel.

FIG. 5 is an enlarged view of the channel 12. In a preferred embodiment the edge in the channel slot 42, of the "C" shaped channel 12, has an optional rolled edge 15 or protective edge 15. The channel 12, is shown as a "C" channel 12, however, the channel 12, can be of any shape, such as a triangular shaped channel 12, a rectangular shaped channel 12, a round shaped channel with a slot 12, or a polygonal shaped channel 12, to name a few.

Figure 6:
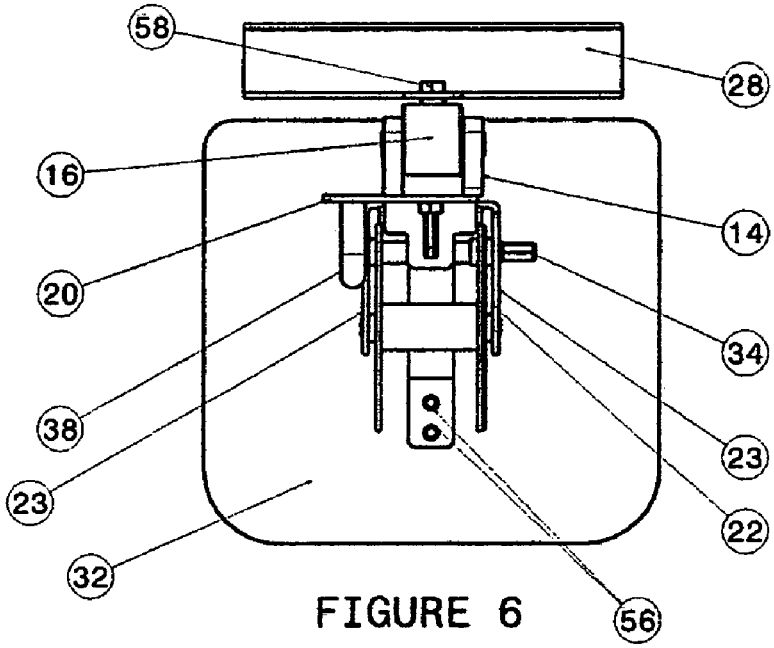
FIG. 6 is a top view a quick panel lifter, taken along section 6-6, from FIG. 1.

FIG. 6 is a top view the quick panel lifter 10, taken along section 6-6, from FIG. 1, where the loader 28, roller 16, base 32, winch 22, winch driver 34, and other related features are clearly shown.

Figure 7:
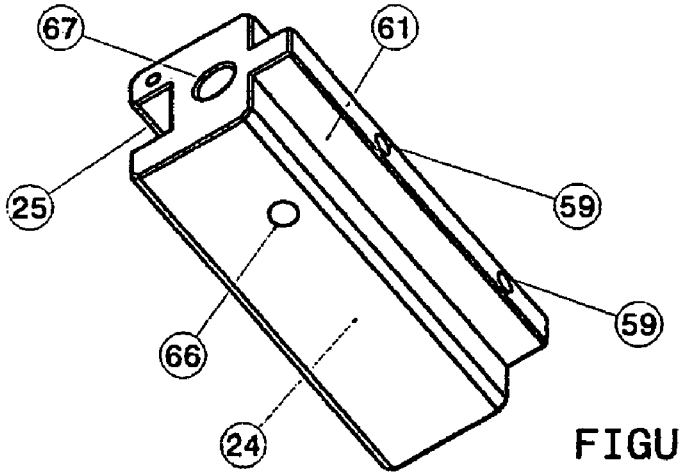
FIG. 7 is an enlarged view of the traveling piston or traveling slide.

FIG. 7 is an enlarged view of the traveling piston 24 or traveling slide 24. In the preferred embodiment the traveling piston 24, has an area 61, which is a standoff 61. The standoff 61, engages the loader 28, at holes 59, at the outer area of channel 12. The traveling piston 24, is shown with at least one hole 67, which receives the cable 36. The cable 36, is preferably held in place with a pin or similar securing device (not shown) inserted into the horizontal hole 66. The traveling piston 24, is also shown with at least one slot 25. The slot 25, functions to offer clearance to mounting screws 58, via holes 59.

Figure 8:
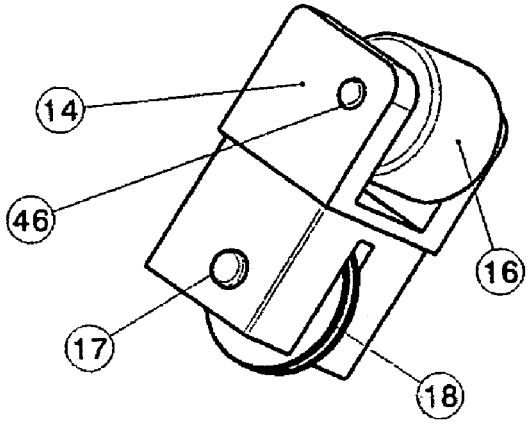
FIG. 8 is an enlarged view of the top assembly.

FIG. 8 is an enlarged view of the top assembly 14, containing the roller 16, and the pulley 18. Pulley 18, is preferably shifted away or set-off from the roller 16, so as to assure contact of the panel 80, with the surface of the roller 16, and that this clearance provides space for the cable 36, to freely move. The pin 17, locates and allows the free rotation of the pulley 18, while pin 46, locates and allows the free rotation of the roller 16. It is preferred that the top assembly 14, has a somewhat smaller body on the lower section so that it can be easily inserted into the channel 12, or removed therefrom. However, this is not necessary as there are a number of other ways to secure the top assembly 14, to the channel 12, such as, by welding or bracing or similar such other securing means.

Figure 9:
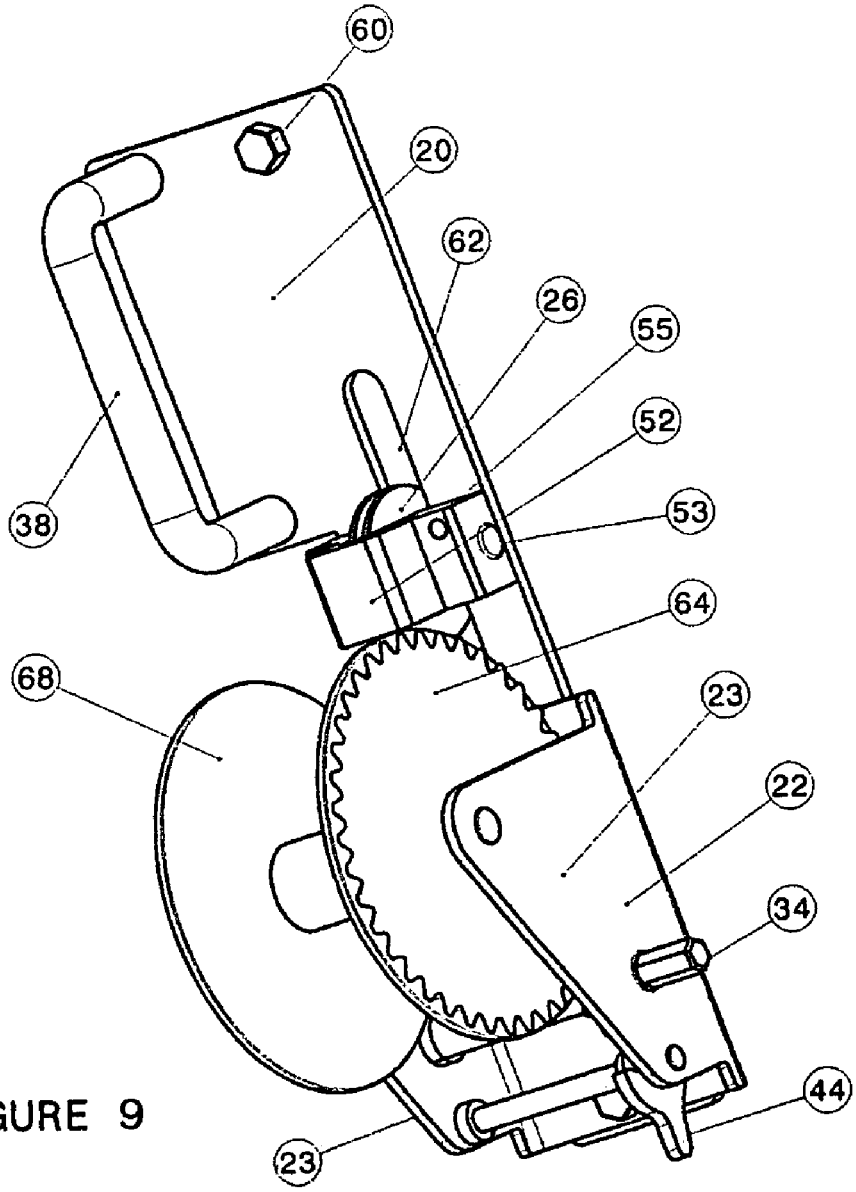
FIG. 9 is an enlarged view of the plate with winch, handle, pulley and lever assembly, taken along section 9-9, from FIG. 1.

FIG. 9 is an enlarged view of the plate 20, with winch 22, handle 38, guide pulley 26, and lever assembly 44, taken along section 9-9, from FIG. 1. In a preferred embodiment the plate 20 or plate assembly 20, is a modular component, having secured thereto, the handle 38, the winch 22, the guide pulley 26, the latch lever assembly 44, and the related components. Pin 53, locates and secures the guide pulley 26, into the guide post 52. In some embodiment one could have a disc 68, having a gear 64, associated therewith. One can also see the slot or opening 62, such as, an oval opening or slot 62, to accommodate the guide pulley 26. The guide post 52, can be securely fastened to the plate 20, with securing means 55, such as with screws 55, or spot welding 55, or similar such other securing means 55.

Figure 10:
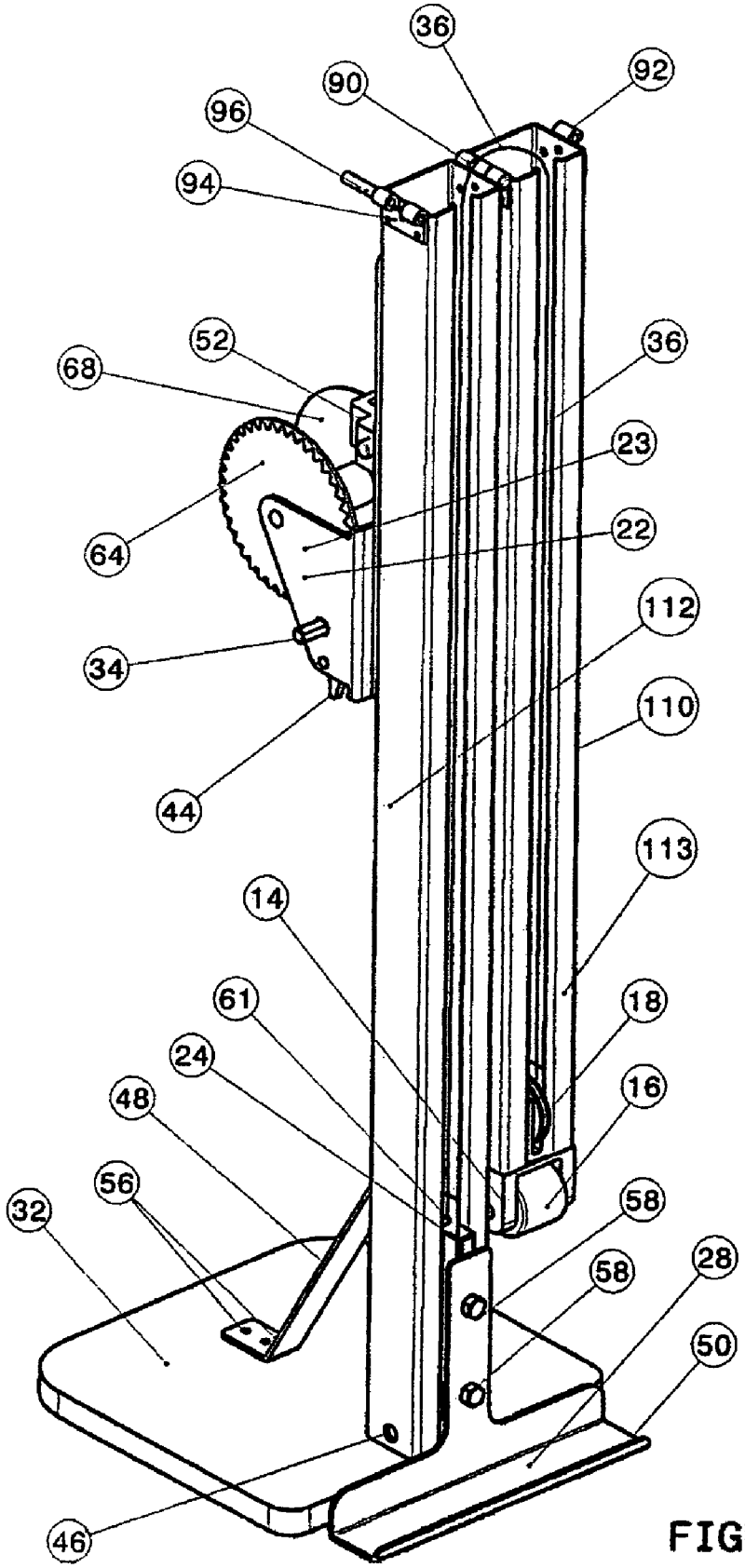
FIG. 10 is an exemplary quick panel lifter which is used to illustrate another embodiment of the present invention.

FIG. 10 is an exemplary quick panel lifter 110, which is used to illustrate another embodiment of the present invention. The quick panel lifter 110, is preferably hinged at about the middle section for easy storage and transportation. The quick panel lifter 110, unit is shown in a folded position. At least one first channel 112, and at least one second channel 113 are shown parallel to each other. Hinge 90, allows the pivotal rotation of channel 113, in relation to channel 112. At least one side hook 92, which is a female connector 92, is attached to channel 113, and at least one side hook 94, which is a female connector 94, is attached to channel 112, such that when the channel 113, is pivotally rotated using pivot hinge 90, the side hook 92, mates with side hook 94, and a pin 96, is made to pass through the side hook 92, and the side hook 94, and vertically aligns with channel 112, and thus channel 113, is vertically aligned and secured with channel 112, such that traveling piston 24, can now slide unimpeded along the channel openings in both channel 112 and channel 113. The cable 36, is shown forming a loop between channel 112 and channel 113, however, when the channel 113, is rotated and aligned for the placement of a panel 80, the cable 36, is in a very taut position. It is preferred that the channel slot 42, is along the full length of the tubular channels 112 and 113.

Figure 11:
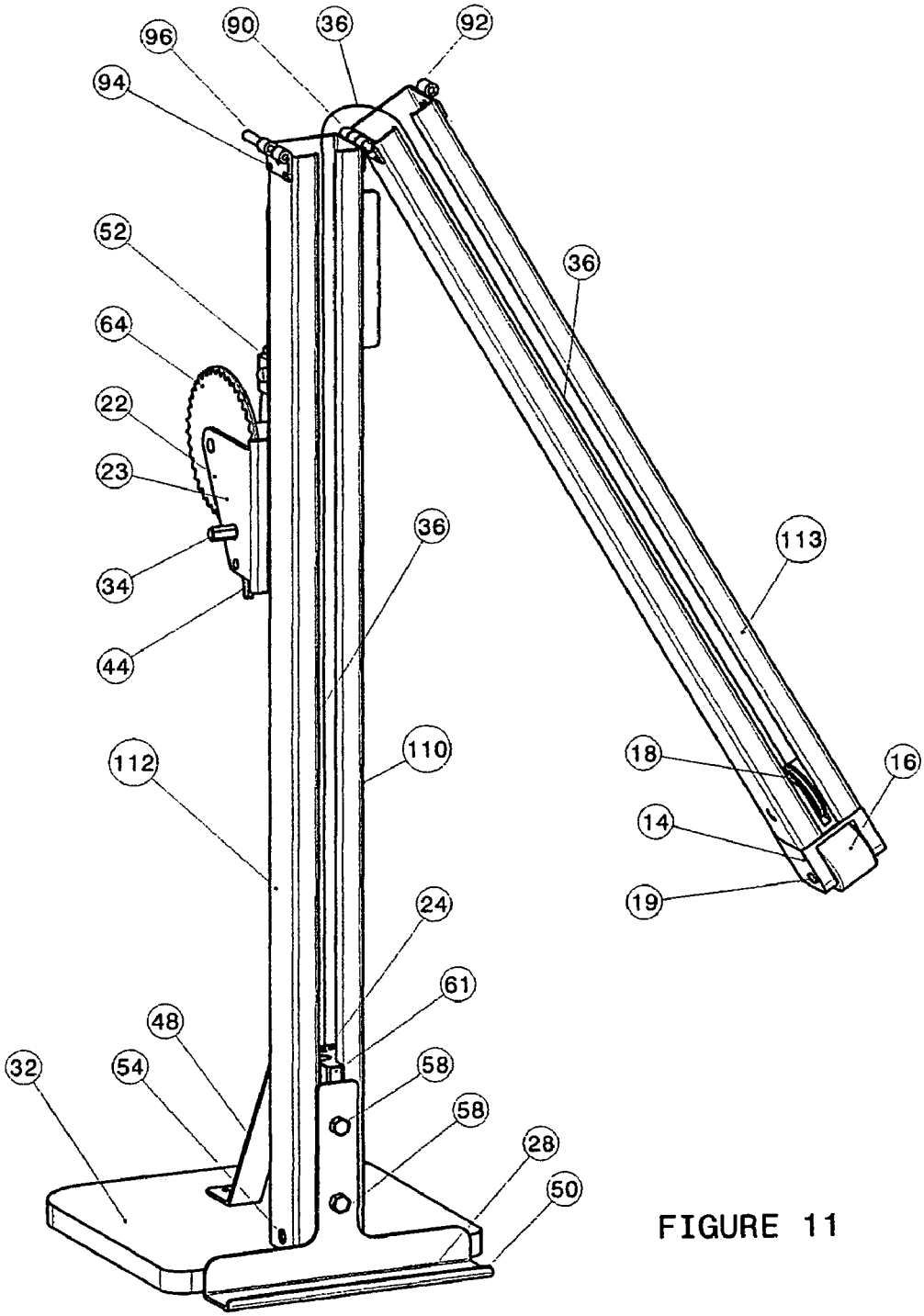
FIG. 11 illustrates the embodiment of FIG. 10 in an intermediate position.

FIG. 11 illustrates the embodiment of FIG. 10 in an intermediate position, where the quick panel lifter 110, is being pivotally rotated around pivot 90 or hinge 90.

Figure 12:
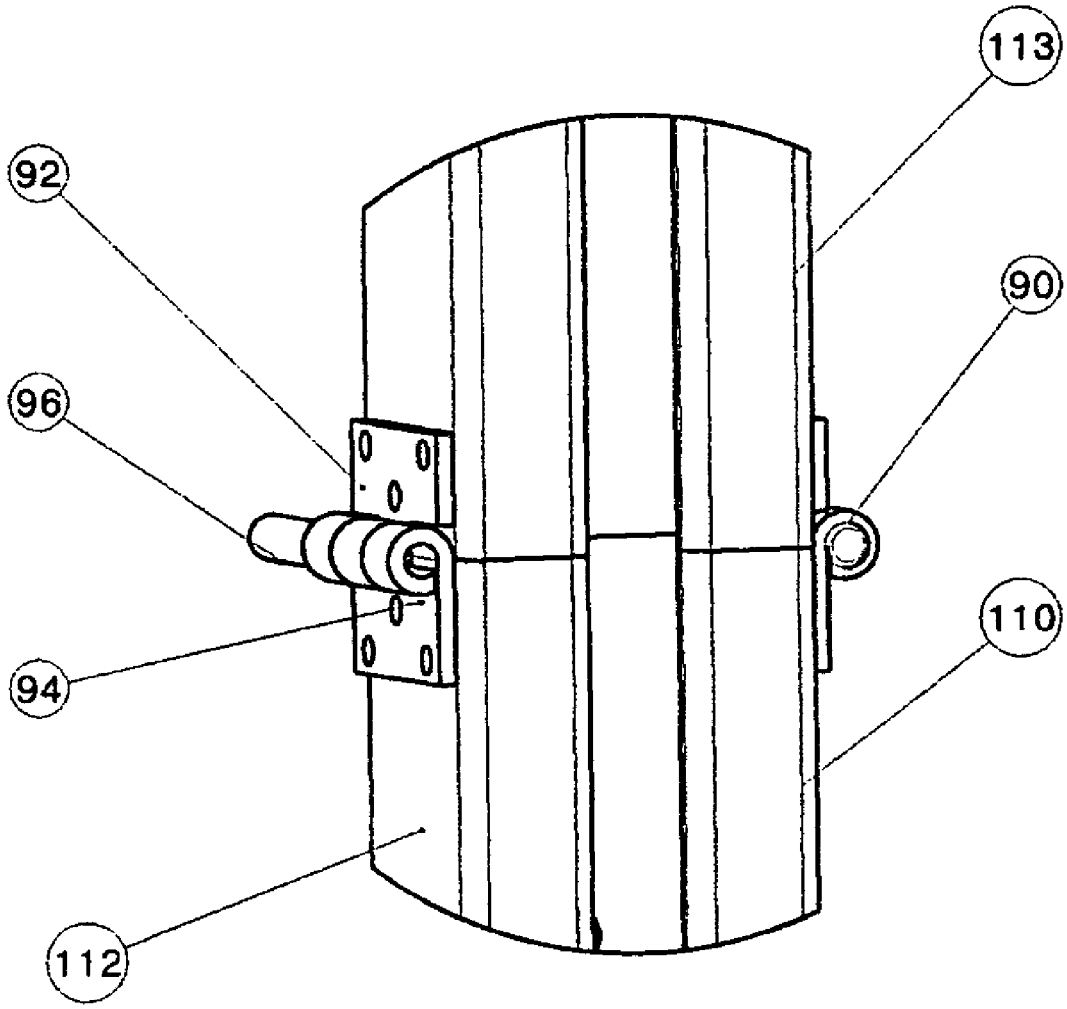
FIG. 12 is an enlarged view of a hinge or hook and locking pins used with an embodiment of the present invention.

FIG. 12 is an enlarged view of hinge 92, 94 or hook 92, 94, and locking pin 96, used with an embodiment of the present invention. In a preferred embodiment of the quick panel lifter 110, the tubular sections 112 and 113, are vertical aligned, and pin 96, are passed through a hook 92, 94 or hinge 92, 94, and locks the channels 112 and 113, in place. The hinge 90, is preferably secured to channels 112 and 113, while hook 92 is on the lower side of channel 113, and hook 94, is on the upper side of the channel 112, and at least one pin 96, securely mates channel 113 to channel 112, via the locking pin 96.

Figure 13:
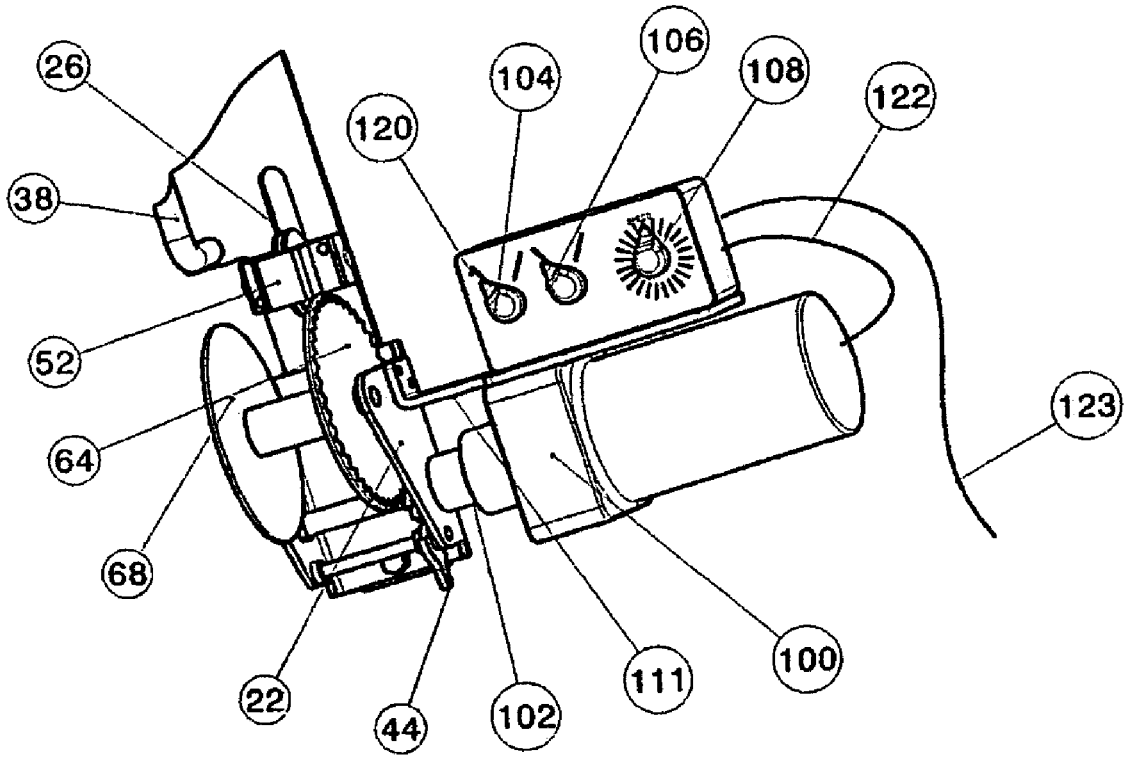
FIG. 13 is yet another embodiment of the present invention.

FIG. 13 is yet another embodiment of the present invention. In a preferred embodiment of the quick panel lifter 10, 110, an electric geared motor 100, is directly attached to the winch driver shaft 34. Preferably, a coupler 102, connects the winch driver 34, to the motor 100. A control box 120, is held in place by at least one bracket 111. The control box 120, preferably has a speed controller knob 108, a direction control switch 106, an ON/OFF switch 104, to name a few. Power cord 112, and connecting cable 122, connects the control box 120, and the motor 100, to an electrical source, such as, a DC source or an AC source.

Figure 14:
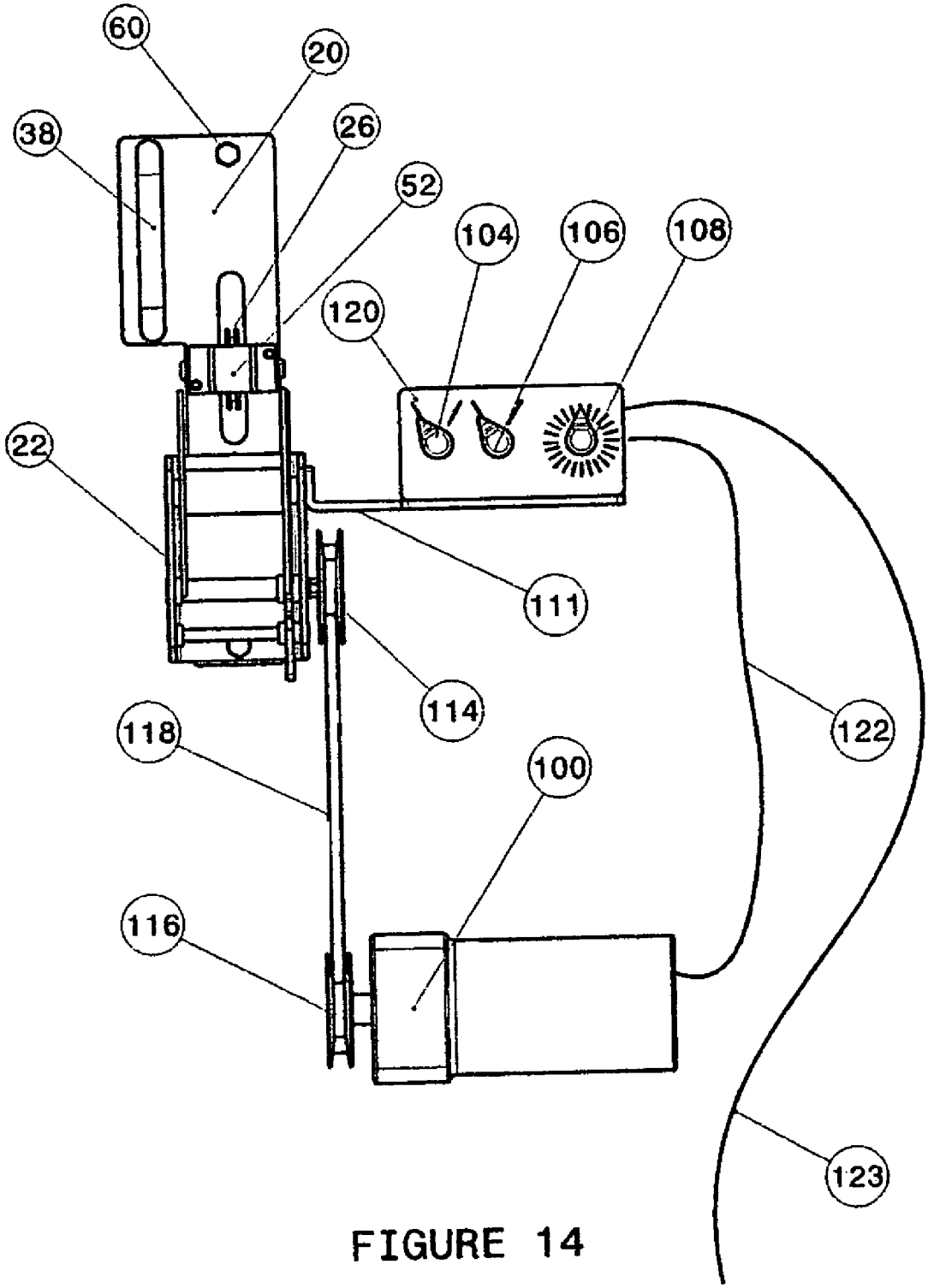
FIG. 14 is still yet another embodiment of the present invention.

FIG. 14 is still yet another embodiment of the present invention for a quick panel lifter 10, 110. In another preferred embodiment, the motor 100, is shown being separated from the winch 22. The motor 100, drives the winch 22, such as, for example, by using at least one belt 118. The motor 100, has a "V-shaped" pulley 116, and the winch 22, also has a "V-shaped" pulley 114. A control box 120, is attached to the winch 22, using at least one bracket 111. Power cable 112, and connecting cable 122, between the control box 120, and the motor 100, provide the electrical source, such as, a DC source or an AC source.

It should be appreciated that the winch drive shaft 34, can be operated with a handle (not shown), a wheel (not shown), or preferably with a household rechargeable electric drill 35, or a motor 100, or a similar electromechanical device.

For some applications the base 32, could have wheels (not shown) to roll the quick panel lifter 10, 110, from a first location to a second location. The base 32, could also have a locking mechanism (not shown) so as to prevent any movement of the quick panel lifter 10, 110, or to keep the quick panel lifter 10, 110, in a stationary position, especially, during the installation of a panel 80.

The panel 80, could be selected from a group comprising, a sheetrock panel 80, a gypsum board panel 80, a plywood panel 80, a glass panel 80, a Plexiglas panel 80, a plastic panel 80, to name a few.

The "L" shaped load holder 28 or loader 28, is preferably attached to the traveling piston 24, such that it engages the panel 80, at the floor level and within a few inches from the wall 11. It is preferred that the panel 80, is loaded onto the loader 28, in such a way that the center of gravity of the panel 80, and the center of gravity of he loader 28, are very close to each other, such as in the center, this is especially important for balancing a large panel 80.

It should be appreciated that the shallow angle that is obtained by loading the panel 80, close to the vertical wall 11, distributes the weight perpendicular to the channel 12, which is attached to the base 32.

For some applications the panel 80, rises along the wall 11, by leaning onto the beams 82, or studs 82, especially, when the panel 80, is being installed. It would be normal for the quick panel lifting device 10, 110, to tilt toward the panel 80, contacting the upper roller 16, especially during positioning when it is controlled by an individual operator holding the handle 38.

The simple compact lifting device 10, 100, allows a single operator to vertically lift and hold construction panels 80, and/or sheetrock 80, to a desired height for securing the panel 80, to a wall 11. The lifting device 10, 110, maintains the panel in position, allowing the operator to move freely about in any direction to adjust and secure the panel 80, on the wall 11. Once the panel 80, is secured in location the latch lever 44, is then released allowing the loader 28, to drop into a home position by it is own weight or with little assistance from the operator or by reversing the drill 35, or motor 100. The device 10, 110, is then ready to install the next panel 80. The lifting device 10, 110, provides an easy method for lifting panels 80, on a wall 11, as high as 12 feet with a single operator. The lightweight apparatus 10, can be a single piece unit 10, or it can be a multi-piece unit 110.

For some application one end of the cable could be secured to the traveling piston while the second end of the cable is secured to the winch mechanism, and wherein the cable could be looped through a pulley in the top assembly and the at least one guide pulley. However, for a modular or a non-modular design the top assembly could be part of the channel itself, e.g. pulley and roller fastened direct to the channel thus eliminating the need of the top assembly While the present invention has been particularly described in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

What is claimed is:

1. A panel lifting device, comprising:

(a) a channel, wherein one end of said channel is secured to a base, while a second end of said channel is secured to a top assembly, wherein said channel has at least one traveling piston slideably secured inside said channel, and wherein said top assembly comprises of at least one roller and at least one pulley;

(b) said traveling piston has a loader secured thereto, wherein said loader has a lip to engage a panel;

(c) a winch mechanism, a lever latch, a gear mechanism, at least one guide pulley and at least one handle secured to said channel;

(d) a cable, wherein one end of said cable is secured to said traveling piston while the second end of said cable is secured to said winch mechanism, and wherein said cable is looped through a pulley in said top assembly and said at least one guide pulley;

(e) wherein said winch mechanism has a winch drive shaft to slidably engage with a rotatable drive shift, such that upon engagement with said rotatable drive shaft said winch drive shaft creates a movement in said cable to vertically move the loader from a first position to a second position.

2. The panel lifting device of claim 1, wherein said cable is selected from a group consisting of a steel cable, a nylon cable, a plastic cable, a cotton cable, and a cable with at least one protective coating.

3. The panel lifting device of claim 1, wherein said first position of said loader is a floor, and said second position of said loader is a final installation place for a panel.

4. The panel lifting device of claim 1, wherein said loader has a lip.

5. The panel lifting device of claim 1, wherein said latch lever engages or disengages from said winch mechanism.

6. The panel lifting device of claim 1, wherein shape of said channel is selected from a group consisting of a "C" shaped channel, a triangular shaped channel, a rectangular shaped channel, a round shaped channel with a slot, and a polygonal shaped channel.

7. The panel lifting device of claim 1, wherein said panel, is selected from a group consisting of a sheetrock panel, a gypsum board panel, a plywood panel, a glass panel, a Plexiglas panel, and a plastic panel.

8. The panel lifting device of claim 1, wherein said lifting device is stoppable at a first position.

9. The panel lifting device of claim 1, wherein said lifting device stands approximately in an upright position with at least one load.

10. The panel lifting device of claim 1, wherein said lifting device stands approximately in an upright position without at least one load.

11. A panel lifting device, comprising:

(a) a channel, wherein one end of said channel is secured to a base, while a second end of said channel is secured to a top assembly, wherein said channel has at least one traveling piston slideably secured inside said channel, and wherein said top assembly comprises of at least one roller and at least one pulley;

(b) said traveling piston has a loader secured thereto, wherein said loader has a lip to engage a panel;

(c) a winch mechanism, a lever latch, a gear mechanism, at least one guide pulley and at least one handle secured to said channel;

(d) a cable, wherein one end of said cable is secured to said traveling piston while the second end of said cable is secured to said winch mechanism, and wherein said cable is looped through a pulley in said top assembly and said at least one guide pulley;

(e) wherein said winch mechanism has a winch drive shaft to slidably engage with a rotatable drive shift, such that upon engagement with said rotatable drive shaft said winch drive shaft creates a movement in said cable to vertically move the loader from a first position to a second position; and (f) wherein said channel has an upper portion and a lower portion, such that said upper portion pivots around said lower portion at a pivot point, and wherein at least one pin secures said upper portion of said channel to said lower portion of said channel at said pivot point.

12. The panel lifting device of claim 11, wherein said cable is selected from a group consisting of a steel cable, a nylon cable, a plastic cable, a cotton cable, and a cable with at least one protective coating.

13. The panel lifting device of claim 11, wherein said first position of said loader is a floor, and said second position of said loader is a final installation place for a panel.

14. The panel lifting device of claim 11, wherein said loader has a lip.

15. The panel lifting device of claim 11, wherein said latch lever engages or disengages from said winch mechanism.

16. The panel lifting device of claim 11, wherein shape of said channel is selected from a group consisting of a "C" shaped channel, a triangular shaped channel, a rectangular shaped channel, a round shaped channel with a slot, and a polygonal shaped channel.

17. The panel lifting device of claim 11, wherein said panel, is selected from a group consisting of a sheetrock panel, a gypsum board panel, a plywood panel, a glass panel, a Plexiglas panel, and a plastic panel.

18. The panel lifting device of claim 11, wherein said lifting device is stoppable at a first position.

19. The panel lifting device of claim 11, wherein said lifting device stands approximately in an upright position with at least one load.

20. The panel lifting device of claim 11, wherein said lifting device stands approximately in an upright position without at least one load.

* * * * *